US006315143B1

(12) United States Patent
Dotts

(10) Patent No.: US 6,315,143 B1
(45) Date of Patent: Nov. 13, 2001

(54) DISPOSABLE STANDING TRASH BAG

(76) Inventor: Antionette R. Dotts, 2640 Market St., East St. Louis, IL (US) 62207

( * ) Notice: Subject to any disclaimer, the term of this patent is extended or adjusted under 35 U.S.C. 154(b) by 0 days.

(21) Appl. No.: 09/454,904

(22) Filed: Dec. 3, 1999

(51) Int. Cl.[7] ..... B65D 33/02

(52) U.S. Cl. ..... 220/9.2; 220/6; 220/904; 220/908; 248/95; 383/104; 383/119

(58) Field of Search ..... 220/9.2, 9.3, 6, 220/495.06, 495.08, 9.1, 9.4, 904, 908; 383/104, 119; 248/95; 141/390

(56) References Cited

U.S. PATENT DOCUMENTS

| | | | | |
|---|---|---|---|---|
| 858,488 | * | 7/1907 | Tynes | 220/9.2 |
| 1,086,002 | | 2/1914 | Stewart | 141/390 |
| 1,278,385 | * | 9/1918 | Rickard | 248/94 |
| 1,647,679 | * | 11/1927 | Williams | 220/9.2 |
| 1,653,393 | | 12/1927 | Cox . | |
| 1,714,308 | | 5/1929 | Gunderson . | |
| 1,848,929 | * | 3/1932 | Berg | 220/9.2 |
| 2,405,627 | * | 8/1946 | Williams | 220/9.2 |
| 2,435,479 | * | 2/1948 | Thommen | 206/315.8 |
| 2,731,184 | | 1/1956 | Thurber | 226/59 |
| 3,410,328 | * | 11/1968 | Sasai | 220/9.2 |
| 3,905,406 | | 9/1975 | Cruse | 141/390 |
| 3,934,803 | | 1/1976 | Paulus, Jr. | 248/99 |
| 4,006,928 | | 2/1977 | Beugin | 294/1 R |
| 4,037,778 | | 7/1977 | Boyle | 229/55 |
| 4,268,081 | | 5/1981 | Hawkinson | 294/55 |
| 4,299,365 | | 11/1981 | Battle | 248/99 |
| 4,440,430 | | 4/1984 | Kruse | 294/1 R |
| 4,537,376 | | 8/1985 | Buku | 248/97 |
| 4,575,895 | | 3/1986 | Spellman | 15/327 |
| 4,640,328 | * | 2/1987 | Arney | 150/55 |
| 4,890,652 | | 1/1990 | Hoerner | 141/10 |
| 5,022,767 | | 6/1991 | Cardulla | 383/33 |
| 6,089,394 | * | 7/2000 | Ziglar | 220/6 |
| 6,102,569 | * | 8/2000 | Wang | 383/104 |

* cited by examiner

*Primary Examiner*—Allan N. Shoap
*Assistant Examiner*—Joseph C. Merek
(74) *Attorney, Agent, or Firm*—Grace J. Fishel

(57) ABSTRACT

A disposable standing trash bag including a flexible container supported by a foldable frame. The frame includes at least one pair of vertically stacked horizontal hoops and a plurality of vertical supports. The supports are pivotally connected to the hoops and fold radially inwardly when the trash bag is folded. A slider restrains folding of the vertical supports when the trash bag is standing but can be released by turning the frame upside down so that the trash bag can be folded for storage, shipment or reuse.

8 Claims, 3 Drawing Sheets

DISPOSABLE STANDING TRASH BAG

BACKGROUND OF THE INVENTION

1. Field of the Invention

The present invention relates to a disposable standing trash bag that can be provided flat for storage, readily set up for use and collapsed after use, if desired, or thrown away.

2. Brief Description of the Prior Art

Washing or scrubbing a trash can is a disagreeable task. Disposable trash bags have been developed for use as trash receptacles. These bags, however, must be used as a liner for a regular trash can or with a frame for supporting the bag as plastic trash bags do not have enough sidewall strength to set upon a floor in the open position and paper trash bags are normally folded as they reach the user and tend to return to the folded position when open. When a trash bag is filled with trash and is pulled out of a trash can or frame, the bag may break, spilling the trash into the can or onto the floor. This event necessitates washing and scrubbing, which the bag was intended to avoid. There are also internal frames that fit into a trash bag for supporting the bag. As waste is placed in the bag, the frame may be soiled, proper sanitation of which requires washing and scrubbing when the frame is withdrawn. U.S. Pat. No. 5,022,767 to Cardulla describes a disposable trash bag with an internal frame that is folded flat before it is used. Once set up, however, the frame is not readily collapsed, hence the bag is for single use only.

In view of the above, it would be desirable to have a disposable standing trash bag which can be thrown away, frame and all, thus eliminating the need for the user to wash anything. Ideally the bag would be collapsible so that it folds flat for shipment but easily sets up when needed. If a user wants to reuse the bag, it would also collapse after it has been emptied.

Sometimes a user needs an extra trash can, for waste or for storage of winter clothing, toys, etc. or for transport of laundry, etc. A disposable standing trash bag would also serve this need, particularly if it is reusable.

BRIEF SUMMARY OF THE INVENTION

In view of the above, it is an object of the present invention to provide a disposable standing trash bag that folds flat for storage or reuse. It is another object to provide a disposable standing trash bag that can be made cheaply enough that a user can afford to throw the entire unit away. Other objects and features of the invention will be in part apparent and in part pointed out hereinafter.

In accordance with the invention, a disposable standing trash bag includes a flexible container in combination with a foldable frame. The flexible container has an open top, a closed bottom and an encircling sidewall. The frame has at least one pair of vertically stacked, upper and a lower horizontal hoops, each of which has a diameter substantially equal to the internal diameter of the encircling sidewall. The frame also includes a plurality of spaced apart vertical supports, each vertical support has a rib with a first end portion pivotally connected at a first pivot to the upper of the horizontal hoops and a second end portion that is free. A strut with a first end portion is pivotally connected at a second pivot to the lower of the horizontal hoops and a second end portion of the strut is pivotally connected to said rib at a third pivot spaced inwardly from said second end portion of the rib.

A slider is provided on the rib that is slidable over the second pivot under force of gravity when the rib is in vertical alignment with the strut until stopped by a stop on either the rib or the strut. The stop prevents the slider from sliding past the second end portion of the rib.

In use, the slider restrains the strut and rib from pivoting at the third pivot when said rib is in vertical alignment with the strut and the trash bag is in upright position. When the disposable standing trash bag is turned upside down and shaken, the slider releases the strut and rib as the slider slides back over the third pivot so that the strut and rib can pivot at the third pivot and the trash bag can be folded into collapsed position for storage.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
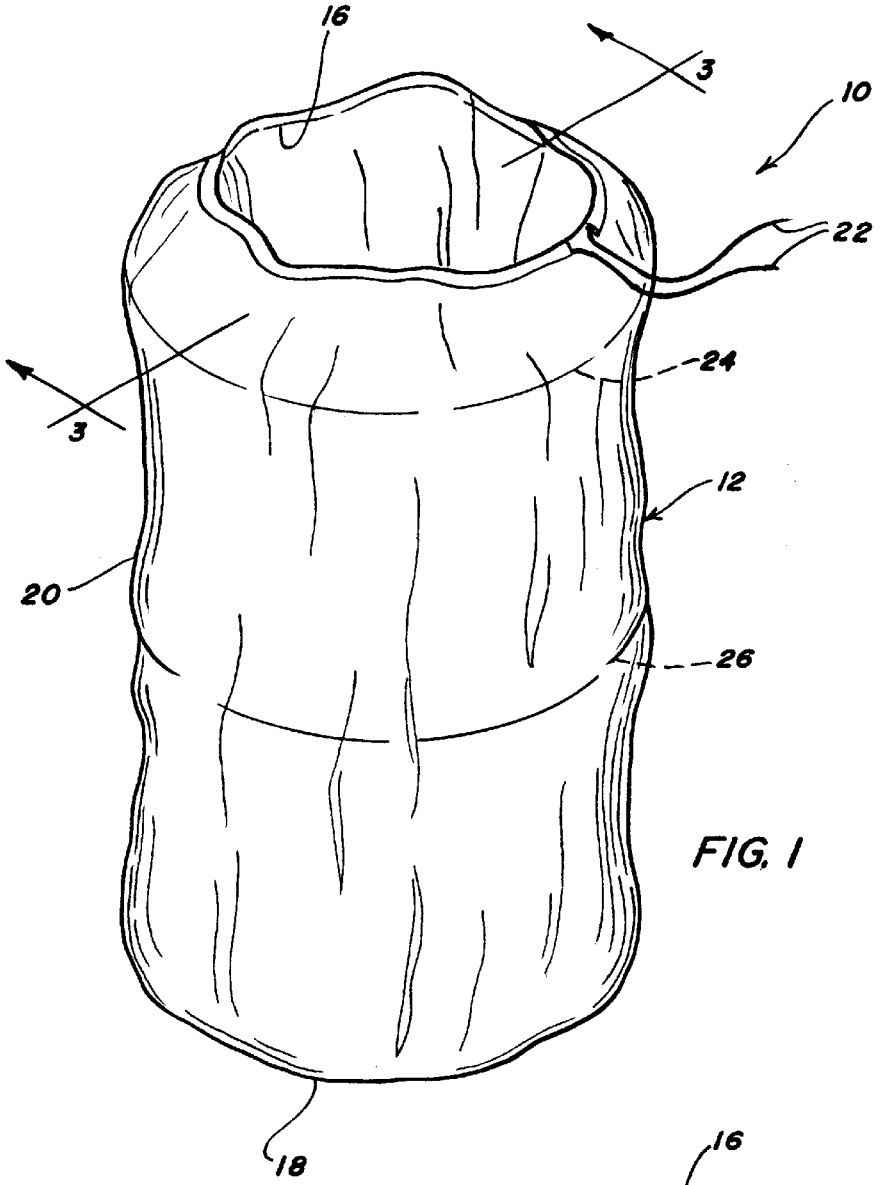
FIG. 1 is a perspective view of a disposable standing trash bag in accordance with the present invention.

Referring to the drawings more particularly by reference character, reference numeral 10 refers to a disposable standing trash bag in accordance with the present invention. Trash bag 10 includes a flexible container 12 and a foldable frame 14.

Flexible container 12 has an open top 16, a closed bottom 18 and an encircling sidewall 20. A draw string 22 may be provided at open top 16 for closing the bag. Alternatively, open top 16 may be closed with a wire tie, clip, etc. or simply knotted. Container 12 is typically formed of a material that does not have sufficient sidewall strength to set on a supporting surface, such as a floor in upright, open position. Suitable materials in this category include sheet plastic and paper. Such containers are typically commercially available in a variety of different sizes and may be made, for example of polyethylene, for home use, garden use, hospital use, institutional use, etc.

Figure 4:
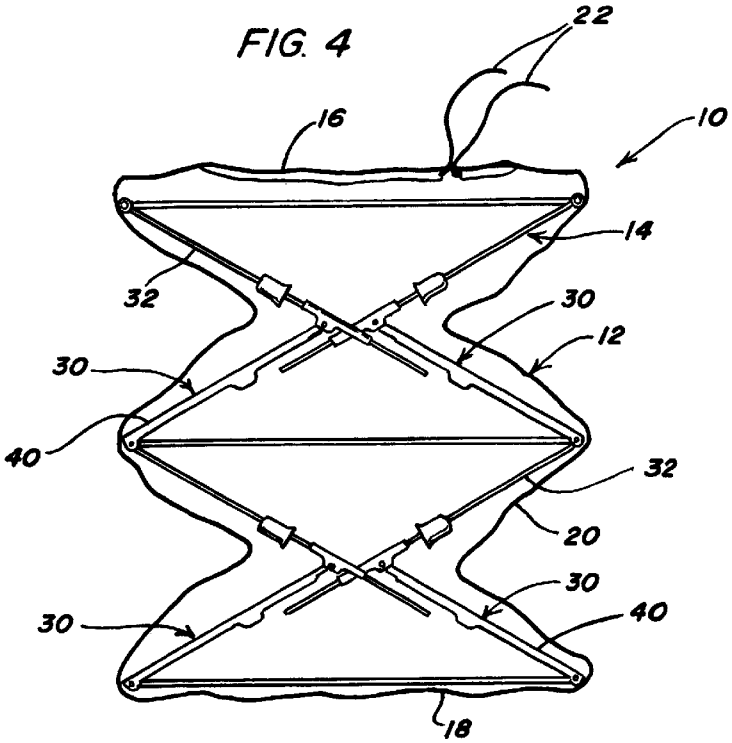
FIG. 4 is a cross section similar to FIG. 3 but showing the trash bag between standing and folded position.
Figure 3:
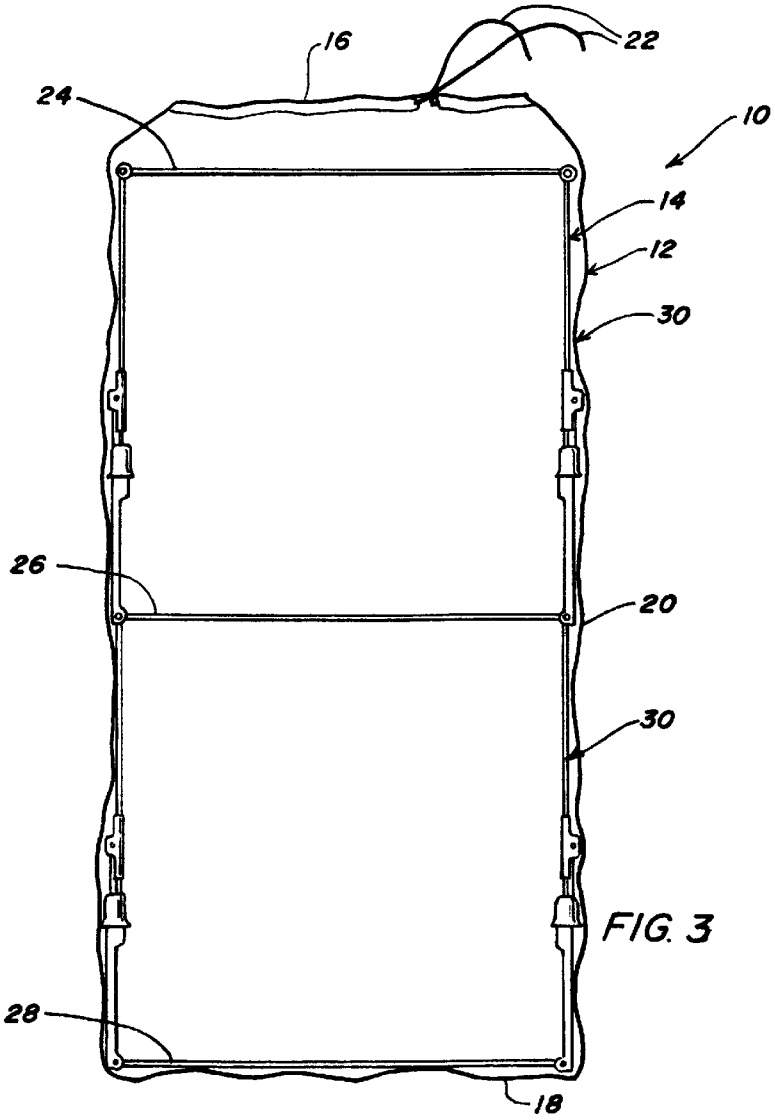
FIG. 3 is a cross-section taken along line 3—3 in FIG. 1.

Foldable frame 14 has at least one pair of vertically stacked, upper (U) and lower (L) horizontal hoops having a diameter substantially equal to the internal diameter of encircling sidewall 20. As shown in FIGS. 3 and 4, three hoops 24, 26 and 28 are provided. Hoop 28 is positioned at closed bottom 18 of container 12 and hoop 24 near open top 16, with hoop 26 in the middle. Hoop 24 is upper (U) with respect to middle hoop 26 (L), while middle hoop 26 is upper (U) with respect to lower hoop 28 (L). While two hoops are necessary to practice the invention, it will be understood that more hoops may be used.

A plurality of spaced apart vertical supports 30 interconnect upper, middle, and lower horizontal hoops 24, 26 and 28. Supports 30 fold radially inwardly (FIGS. 4 and 7) and are preferably equiangularly spaced about hoops 24, 26 and 28. As shown in FIG. 3, two vertical supports 30 are positioned in opposing pairs with supports 30 interconnecting hoops 24 and 26 generally vertically aligned (FIG. 6) with supports 30 interconnecting hoops 26 and 28 when trash bag 10 is in standing position. A second pair of vertical supports 30 are orthogonal to the supports shown in FIG. 3 but were eliminated from the drawing for clarity.

As best seen in FIGS. 5–8 each vertical support 30 includes a rib 32 with a first end portion 34 pivotally connected at a first pivot 36 to upper hoop (U) and a second end portion 38 that is free. A strut 40 with a first end portion 42 is pivotally connected at a second pivot 44 to lower hoop (L). A second end portion 46 of strut 40 is pivotally connected to rib 32 at a third pivot 48 spaced inwardly from said second end portion 38 of the rib. As will be apparent, the pivots are not limited to those particular pivots shown in the drawings, a description of which follows.

First and second pivots 36 and 44, respectively, as shown in the drawings, comprise a cylinder 50 journaled on the hoop. Side braces 52 interconnecting cylinder 50 and rib 32 or strut 40 may be provided for lateral support. Third pivot 48 comprises a bracket 54 attached to rib 32 with a pair of ears 56 between which second end portion 46 of strut 40 is pinned. First and second pivots 36 and 44 are restrained from sliding movement on upper and lower hoops U, L.

Figure 8:
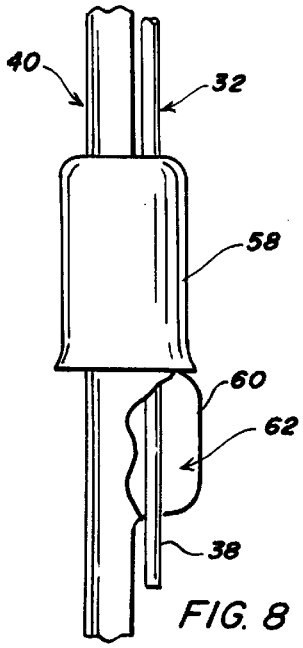
Figure 5:
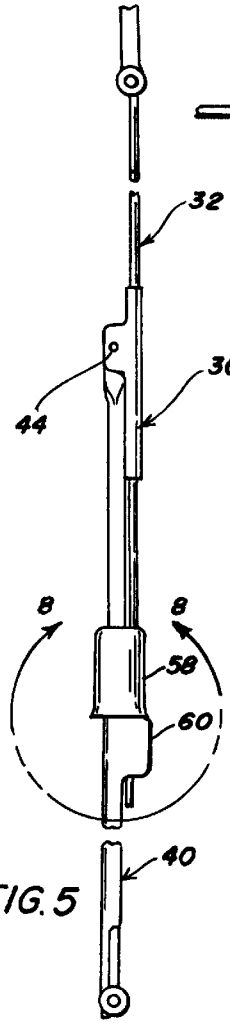
FIG. 5 is a side elevation on an enlarged scale of a vertical support when the trash bag is in standing position.
Figure 6:
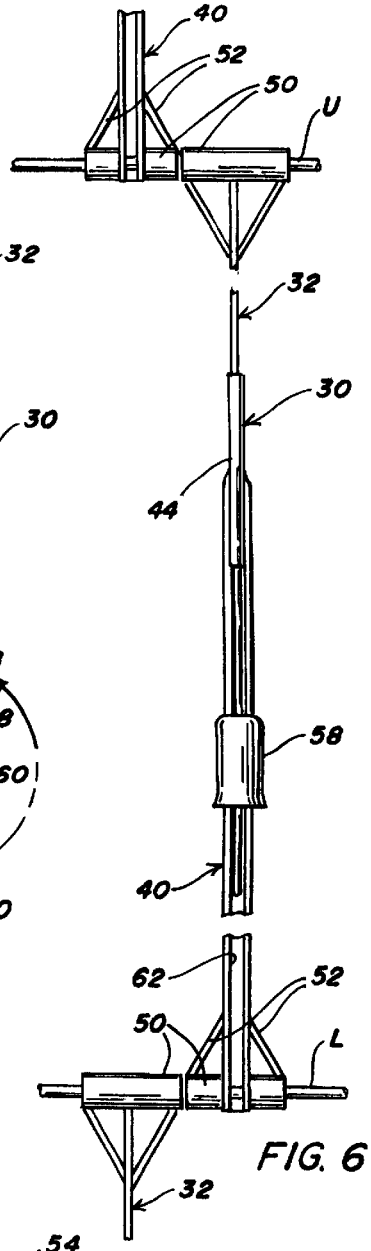
FIG. 6 is an elevation of the vertical support, viewed from the inside of the horizontal hoops.
Figure 7:
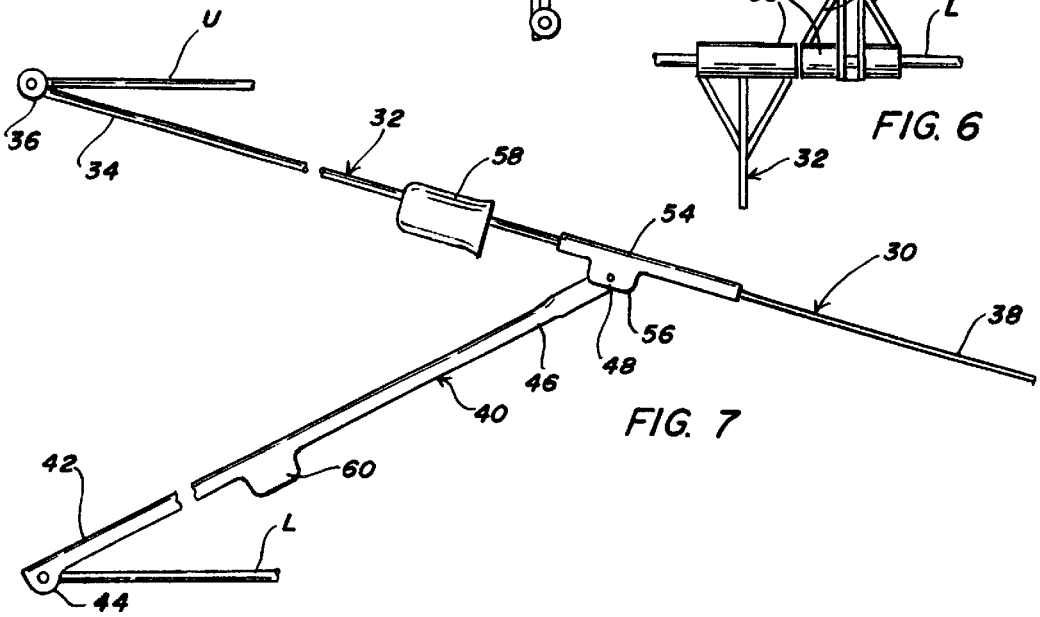
FIG. 7 is a side elevation of a vertical support when the trash bag is between standing and folded position; and, FIG. 8 is a detail, partly in section and on a further enlarged scale, taken along line 8—8 in FIG. 5.

With continuing reference to FIGS. 5–8, a slider 58 is provided on each rib 32. As best seen in FIGS. 5—6 and 8, slider 58 is slidable over second pivot 44 under force of gravity when rib 32 is in vertical alignment with strut 40. A stop 60 is provided on either rib 32 or strut 40 to prevent slider 58 from sliding past second end portion 38 of rib 32. Preferably, a U-shaped channel 62 is mounted on one of rib 32 and strut 40 so as to engage a portion of the other of the rib and strut at a position near second end portion 38 of rib 32 to restrain lateral or sideways movement of the rib in relationship to the strut when the rib and strut are in vertical alignment. As shown in the drawings, strut 40 is U-shaped in cross section, forming U-shaped channel 62 with stop 60 formed as a pair of ears extending outwardly from the sidewalls of the channel.

Frame 14 may be formed of metal, wood or plastic. Metal is presently preferred because of the commercial availability of ribs 32 and struts 40, which are used in the construction of folding umbrellas. It will be understood, however, that frame may be formed of other sufficiently rigid materials, metal being preferred for the reasons given.

Hoops 24, 26, and 28 are preferably attached to encircling sidewall 20 of flexible container 12. This may be accomplished with tape, glue or the like. When frame 14 is formed of plastic and flexible container is formed of a plastic sheet, hoops 24, 26 and 28 may be heat welded or the like to encircling sidewall 20.

Figure 2:
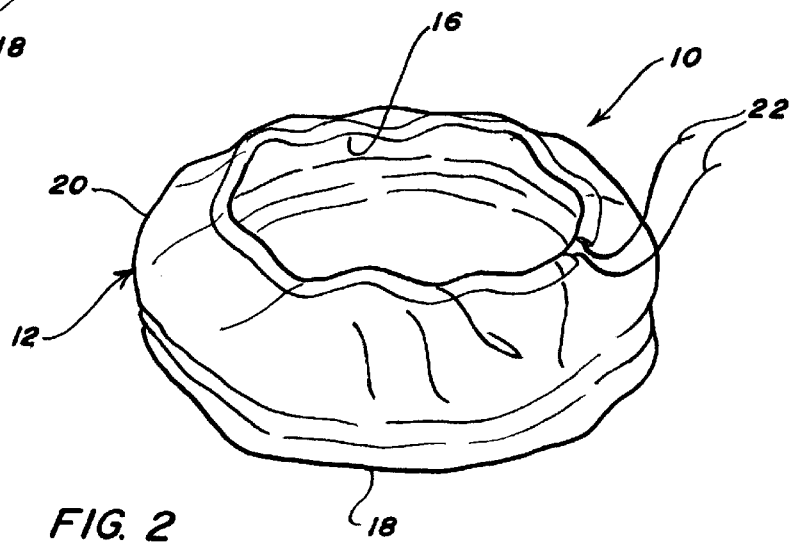
FIG. 2 is a perspective view of the trash bag in folded condition.

In use, as shown in FIG. 2, disposable standing trash bag 10 is folded flat for packaging and distribution to the user. When an individual trash bag 10 is separated from the packaging, it is grasped by open top 16 and given a shake. In most instances, this will cause ribs 32 and struts 40 to pivot radially outwardly on hoops 24, 26 and 28 and slider 58 to lock third pivot 48. If necessary, the user may reach into the inside of trash bag 10 to bring ribs 32 and struts 40 into vertical alignment and push slider 58 down over third pivot 48 to lock second end portion 38 of rib 32 into U-shaped channel 62.

Once set up, disposable standing trash bag 10 can be placed on a flat surface, such as a floor, without additional support. When the trash bag 10 is full, open top 16 can be closed by pulling on draw string 22, tied off with a wire tie, or the like, and thrown away, flexible container, foldable frame and all. With trash bag 10, there will be no arguments concerning who is going to take out the garbage since it will be easy to dispose of the trash without spilling. There will also be no more loose papers in the yard like an ordinary trash can which sanitation workers pick up by the handles and dump into a larger can, scattering waste. Best of all, however, there will be no trash can to wash or scrub.

Under some circumstances, if desired, the trash may be emptied from disposable standing trash bag 10 and the bag refolded. This is accomplished by holding trash bag 10 upside down, allowing sliders 58 to slide along ribs 32 under force of gravity. Once sliders 58 are above third pivot 48, strut 40 and rib 32 are free to pivot, such that frame 14 can be folded back into collapsed condition, ready for storage. There is no reason to throw away disposable standing trash bag 10 if the material initially stored in it has not soiled the inside of the bag, for example when the bag is used for storage of winter clothing, toys, etc. or for transport of laundry, etc. On the other hand, disposable standing trash bag 10 can be made inexpensively enough that a user, who needs an extra trash can, can afford to throw the unit away when the need is over, even though it could be reused.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A disposable standing trash bag comprising a flexible container having an open top, a closed bottom and an encircling sidewall in combination with a foldable frame inside the container, said frame comprising:

at least three vertically stacked horizontal hoops, each of said hoops having a diameter substantially equal to the internal diameter of the encircling sidewall;

a first plurality of spaced apart vertical supports, each vertical support having a rib with a first end portion journaled on an upper of the horizontal hoops and a second end portion that is free, and a strut having a first end portion journaled on a middle of the horizontal hoops and a second end portion pivotally connected to said rib at a third pivot spaced substantially inwardly from said second end portion of the rib, a second plurality of spaced apart vertical supports, each vertical support having a rib with a first end portion journaled on the middle of the horizontal hoops and a second end portion that is free, and a strut having a first end portion journaled on a lower of the horizontal hoops and a second portion pivotally connected to said rib at a third pivot spaced substantially inwardly from said second end portion of the rib; and, a slider on the rib slidable over the second pivot under force of gravity when the rib is in vertical alignment with the strut and a stop on one of said rib and said strut preventing said slider from sliding past said second end portion of the rib, whereby said slider restrains the strut and rib from pivoting at the third pivot when said rib is in vertical alignment with the strut but releases the strut and rib when the metal frame is turned upside down and the slider slides back over the third pivot, releasing the second end portion of the rib so that the strut and rib can pivot at the third pivot and allowing the frame to fold with the strut and the rib extending radially inwardly of the hoops.

2. The trash bag of claim 1 further comprising a generally U-shaped channel mounted on one of said rib and said strut so as to engage a portion of the other of said rib and said strut at a position near the second end portion of the rib to restrain lateral or sideways movement of said rib in relationship to said strut when the rib is in vertical alignment with the strut.

3. The trash bag of claim 2 wherein the container is attached to the hoops.

4. A disposable standing trash bag comprising a flexible container formed of a thermoplastic material having an open top, a closed bottom and an encircling sidewall in combination with a foldable metal frame inside the container, said frame comprising:

at least three vertically stacked horizontal hoops, each of said hoops having a diameter substantially equal to the internal diameter of the encircling sidewall;

a first plurality of spaced apart vertical supports, each vertical support having a rib with a first end portion journaled on an upper of the horizontal hoops and a second end portion that is free, and a strut having a first end portion journaled on a middle of the horizontal hoops and a second end portion pivotally connected to said rib at a third pivot spaced substantially inwardly from said second end portion of the rib, a second plurality of spaced apart vertical supports, each vertical support having a rib with a first end portion journaled on the middle of the horizontal hoops and a second end portion that is free, and a strut having a first end portion journaled on a lower of the horizontal hoops and a second portion pivotally connected to said rib at a third pivot spaced substantially inwardly from said second end portion of the rib; and, a slider on the rib slidable over the second pivot under force of gravity when the rib is in vertical alignment with the strut and a stop on one of said rib and said strut preventing said slider from sliding past said second end portion of the rib, whereby said slider restrains the strut and rib from pivoting at the third pivot when said rib is in vertical alignment with the strut but releases the strut and rib when the metal frame is turned upside down and the slider slides back over the third pivot, releasing the second end portion of the rib so that the strut and rib can pivot at the third pivot and allowing the frame to fold with the strut and the rib extending radially inwardly of the hoops.

5. The trash bag of claim 4 with three hoops and wherein the vertical supports are equiangularly spaced about the hoops with the vertical supports connecting a first pair of the hoops generally vertically aligned with the vertical supports connecting a second pair of the hoops.

6. The trash bag of claim 4 further comprising a generally U-shaped channel mounted on one of said rib and said strut so as to engage a portion of the other of said rib and said strut at a position near the second end portion of the rib to restrain lateral or sideways movement of said rib in relationship to said strut when the rib is in vertical alignment with the strut.

7. The trash bag of claim 6 wherein the container is attached to the hoops.

8. The trash bag of claim 6 wherein the container is taped to the hoops.

* * * * *